US006217189B1

(12) United States Patent
Nassim

(10) Patent No.: US 6,217,189 B1
(45) **Date of Patent: *Apr. 17, 2001**

(54) ARRANGEMENT FOR AND METHOD OF CONCEALINGLY MOUNTING FLANGED DEVICES, ESPECIALLY CEILING LIGHT FIXTURES

(76) Inventor: Eli Nassim, 33 Acorn Ponds Dr., North Hills, NY (US) 11576

( * ) Notice: Subject to any disclaimer, the term of this patent is extended or adjusted under 35 U.S.C. 154(b) by 0 days.

This patent is subject to a terminal disclaimer.

(21) Appl. No.: 09/287,868

(22) Filed: Apr. 7, 1999

Related U.S. Application Data

(63) Continuation-in-part of application No. 09/078,215, filed on May 13, 1998.

(51) Int. Cl.[7] ..... F21S 1/02

(52) U.S. Cl. ..... 362/147; 362/147; 362/148; 362/150; 362/364; 362/365; 362/404

(58) Field of Search ..... 362/147, 148, 362/150, 364, 365, 404

(56) References Cited

U.S. PATENT DOCUMENTS

| | | | | |
|---|---|---|---|---|
| 2,998,511 | * | 8/1961 | Chan | 362/147 |
| 4,729,074 | | 3/1988 | Steadman . | |
| 5,034,869 | * | 7/1991 | Choi | 362/363 |
| 5,921,655 | * | 7/1999 | Nassim | 362/147 |
| 5,957,572 | * | 9/1999 | Wedekin et al. | 362/365 |

FOREIGN PATENT DOCUMENTS

| | | |
|---|---|---|
| 40 13 457 | 10/1991 | (DE) . |
| 2 683 616 | 5/1993 | (FR) . |

* cited by examiner

*Primary Examiner*—Sandra O'Shea
*Assistant Examiner*—Anabel M. Ton
(74) *Attorney, Agent, or Firm*—Kirschstein, et al.

(57) ABSTRACT

A mounting arrangement for, and a method of, concealing a flange on a device, such as a lighting fixture, to be mounted on a wall, such as a ceiling, includes a support and a mask element. The support has a mounting hole extending through the support for mounting the device, a flange recess formed in the support for receiving the flange of the mounted device, and a mask recess formed in the support. The mask element is received in the mask recess and overlies the flange of the mounted device to hide the flange from view. The support has a peripheral flange that overlies, rests on, and is supported by, an interior wall surface of the ceiling.

20 Claims, 4 Drawing Sheets

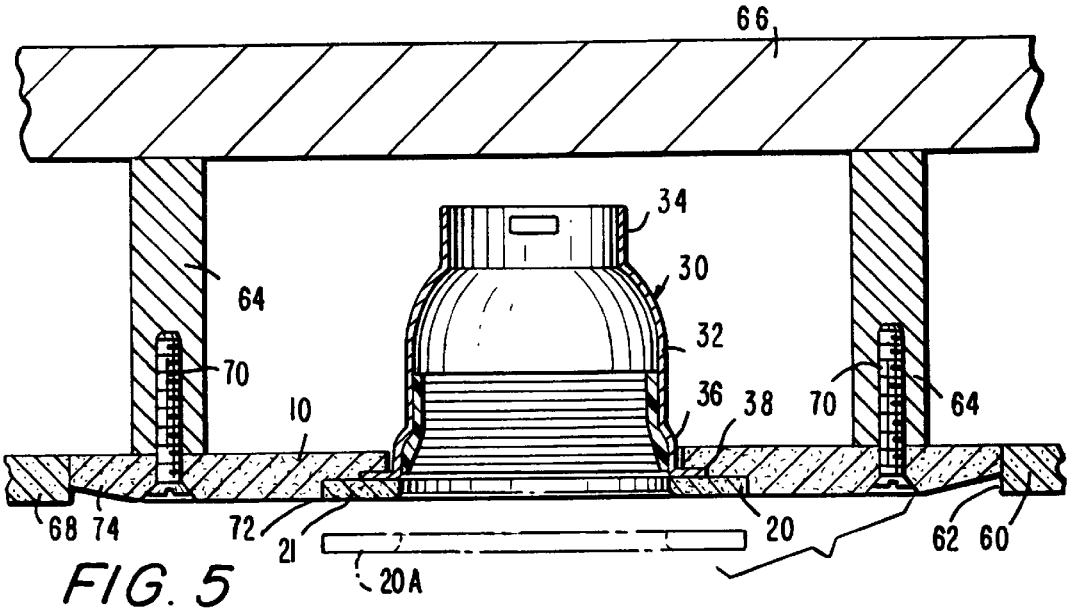
FIG. 5
FIG. 6
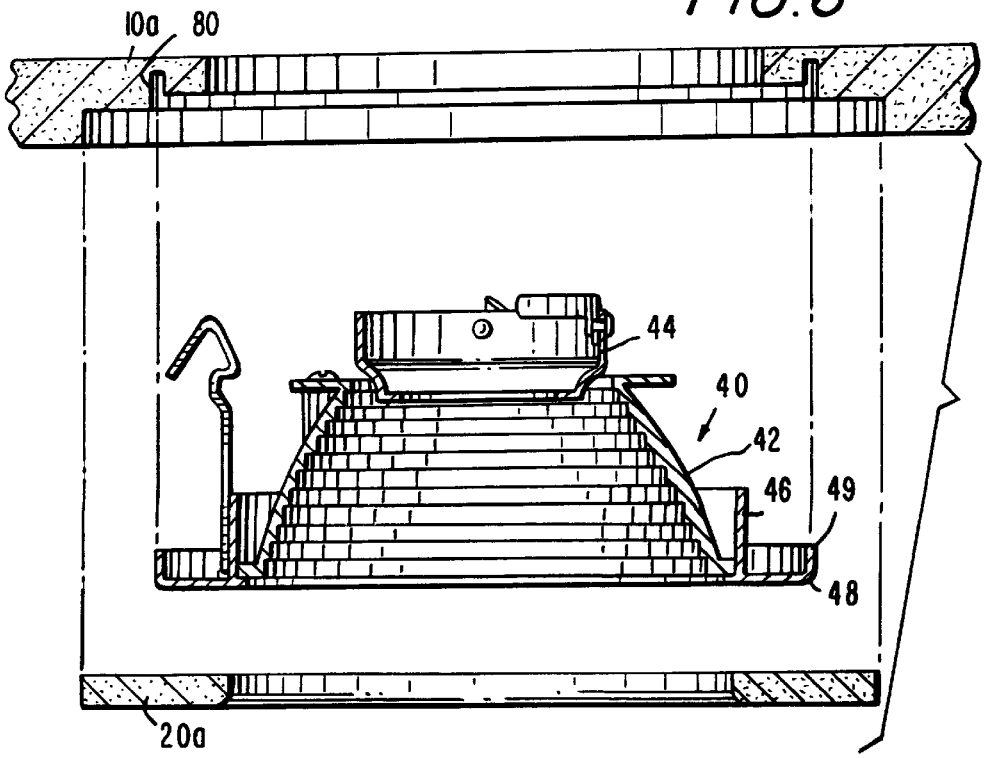

ARRANGEMENT FOR AND METHOD OF CONCEALINGLY MOUNTING FLANGED DEVICES, ESPECIALLY CEILING LIGHT FIXTURES

CROSS REFERENCE TO RELATED APPLICATION

This application is a continuation-in-part of U.S. patent application Ser. No. 09/078,215, filed May 13, 1998, now allowed.

BACKGROUND OF THE INVENTION

1. Field of the Invention

The present invention relates in general to an arrangement for and a method of mounting a flanged device, such as a light fixture, on a room wall, especially a ceiling and, more particularly, to concealing the flange of the mounted device from view.

2. Description of the Related Art

There are already known various constructions of room light fixtures and built-in recessed lighting installations that are used to illuminate a room in a non-obtrusive manner, i.e., without the use of pole lamps, table lamps, sconces, wall lamps, track lighting, or like fixtures that extend from a room wall into a room and occupy a non-negligible space within the room. Details of such constructions can be had by reference to the following U.S. Pat. Nos.: 1,799,304; 2,218,731; 2,998,511; and 4,408,262.

Although generally satisfactory for their intended purpose, the known wall-mounted installations suffer from an objectionable drawback, namely, their presence is still noticeable after installation. An exposed part of the fixture, no matter how slight, represents an unsightly detail to be avoided. In the case of a ceiling light fixture, an abutment flange is typically located at the periphery of the lighting fixture. The purpose of this flange is to abut the underside of the ceiling when the fixture is inserted into a mounting hole cut into the ceiling. The flange limits how far the fixture is recessed into the ceiling. However, as stated above, the flange remains visible after installation, is unsightly, can cause objectionable shadow effects, and does not present a finished, uninterrupted, smooth, flush surface with the ceiling. Even worse, it often happens that the fixture drops below the ceiling due to poor installation or vibration, thereby causing the flange to be even more noticeable. Modern architectural and room design demand such continuous surfaces.

OBJECTS OF THE INVENTION

Accordingly, it is a general object of the present invention to avoid the disadvantages of the prior art.

More particularly, it is an object of the present invention to provide a mounting arrangement for a flanged fixture that does not possess the drawbacks of the known mounting arrangements of this type.

Still another object of the present invention is to devise a mounting arrangement of the type here under consideration which is capable of concealing the fixture, especially the exposed abutment flange.

Still another object of the present invention is to conceal the flange, to avoid objectionable shadow effects, and to present a finished, uninterrupted, smooth, flush surface with the ceiling.

A concomitant object of the present invention is so to construct the mounting arrangement of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in a mounting arrangement for concealing a flange on a device, e.g., a lighting fixture, to be mounted on a wall, e.g., a ceiling. The mounting arrangement includes a support having a mounting hole extending through the support for mounting the device, a flange recess formed in the support for receiving the flange of the mounted device, and a mask recess formed in the support. A mask element is received in the mask recess and overlies the flange of the mounted device to hide the flange from view. The hidden flange no longer represents an unsightly, objectionable detail.

In the preferred embodiment, the support has opposite major surfaces, the hole extends through the major surfaces, the flange recess is located between the major surfaces within the support, and the mask recess is located at one of the major surfaces. More specifically, the major surfaces are generally planar, the hole extends along a longitudinal axis generally perpendicular to the major surfaces, and the flange recess and the mask recess extend circumferentially around the axis. Preferably, the flange recess and the mask recess have concentric, circular configurations, but they could have other shapes, such as square or rectangular.

In accordance with another feature of this invention, the flange recess and the mask recess are bounded by smooth, continuous boundary walls and have a complementary contour to the flange and the mask element, respectively. The support is molded of a moldable, non-metallic material, preferably plaster or plastic. The mask element is a circular ring molded of the same moldable, non-metallic material. The mask element has an outer face that is flush with said one major surface of the support, thereby obtaining the above-described finished look so sought after in modern architectural design. For even greater design interest, the outer face of the mask element can be molded and/or imprinted with any pattern or design, such as a geometric or floral design.

The method of mounting the device and of concealing the flange on the mounted device is performed as follows:

First, a section of a finished or partly finished ceiling is removed. Then, the support is inserted in the removed section. The support has previously been formed with the mounting hole, flange recess and mask recess described above.

Next, the device is inserted through the mounting hole until the flange is placed in and abuts the flange recess. The aforementioned mask element is placed in the mask recess in an overlying relationship with the flange of the mounted device to hide the flange from view.

The support is advantageously formed with an outer, generally planar surface and the mask element is formed with an outer, generally planar face. The outer surface of the support is made flush with the outer face of the mask element, typically by applying a spackling compound and sanding the compound flat in known manner.

Finally, it is advantageous if the support is provided with beveled edge regions at the periphery of the support. These beveled edge regions of the support are made flush with the wall as described before, that is, by spackling a joint compound and sanding the compound flat in known manner.

The support is held overhead by securement to ceiling joists or neighboring ceiling structures or, in an advantageous embodiment, by securement to the ceiling itself, either by fasteners or by resting on an upper, inner surface of the ceiling. The support may have a peripheral flange that is circumferentially complete, or split to form a plurality of radial arms. The ceiling is prepared by being formed with a cutout through which the support passes. Thereupon, by turning the support through an angular distance, the flange rests on the upper, inner ceiling surface, thereby enhancing the securement.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 5 is a broken-away, sectional view of a first type of ceiling lighting fixture mounted using the support of FIG. 2 and the mask element of FIG. 4, the mask element also being shown in phantom lines prior to placement in the mask recess;

FIG. 6 is an exploded view analogous to FIG. 5, but of a second type of ceiling lighting fixture mounted using a modified support and a modified mask element in accordance with the present invention;

DETAILED DESCRIPTION OF THE PREFERRED EMBODIMENTS

Figure 1:
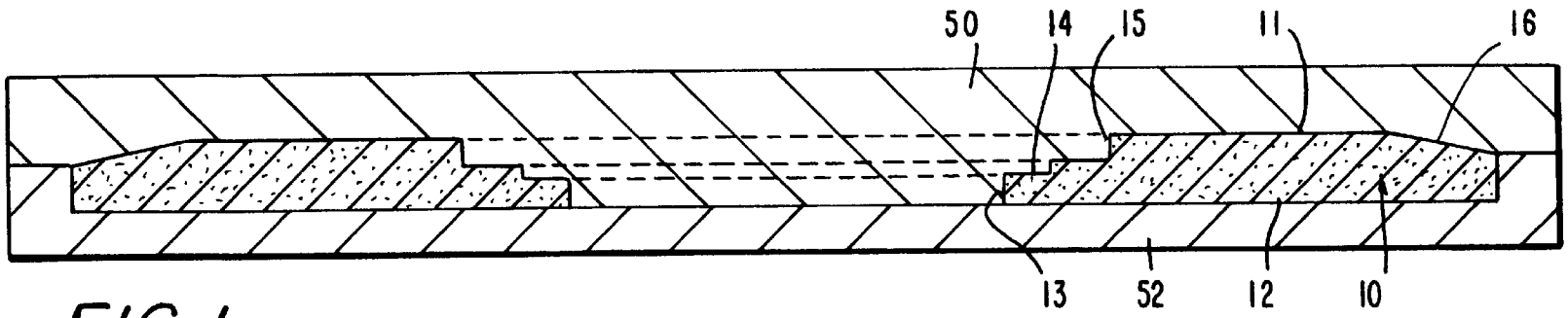
FIG. 1 is a sectional view of a support in accordance with the present invention during its manufacture in a mold.
Figure 2:
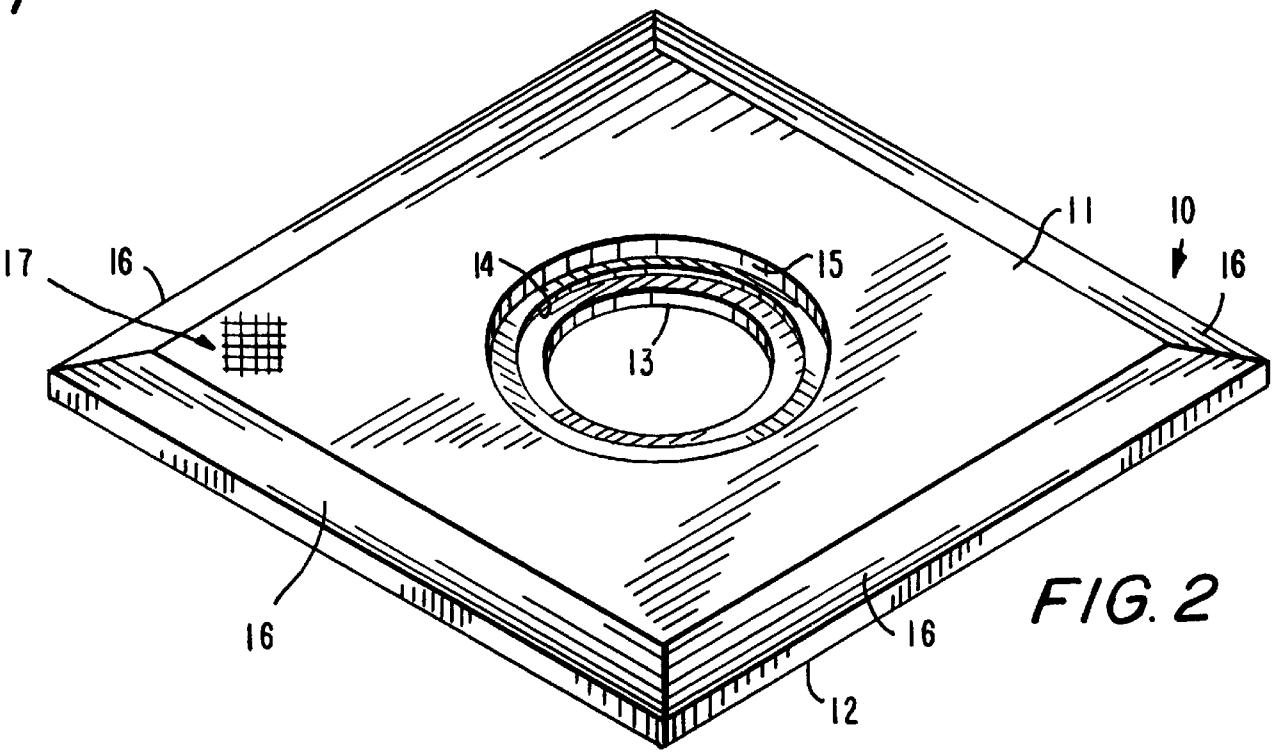
FIG. 2 is a perspective view of the finished support of FIG. 1 after its manufacture.

Referring now to the drawing in detail, and first to FIGS. 1 and 2 thereof, it may be seen that the reference numeral 10 has been used therein to identify a generally planar support, also known as a "tile", of the present invention in its entirety. The reference numeral 20 has been used in FIGS. 3 and 4 of the drawing to identify a generally planar mask element, also known as a "ring", in its entirety. The support 10 and the mask element 20 are used together to mount a device, such as a first type of light fixture 30 depicted in FIG. 5, or, the support and the mask element 20 can be modified, as explained below, to mount another device, such as a second type of light fixture 40 depicted in FIG. 6.

The fixture 30 is entirely conventional and forms no part of this invention. The fixture includes a hollow housing or "can" 32 whose inner cylindrical end or "neck" 34 receives a non-illustrated electrical light socket and bulb, and whose outer cylindrical end 36 is bounded by a peripheral, flat, circular, metallic, abutment flange 38. It is this metal flange that in conventional lighting installations abuts the underside of a ceiling and by its mere physical presence represents an "eyesore".

In analogous manner, the fixture 40 is entirely conventional and forms no part of this invention. The fixture 40 also includes a hollow housing or "can"42 whose inner cylindrical end or "neck" 44 receives a non-illustrated electrical light socket and bulb, and whose outer cylindrical end 46 is bounded by a peripheral, circular, metallic, abutment flange 48. The metal flange 48 is not entirely flat as in the case of flange 38, but instead also has a bent lip 49. In conventional lighting installations, this lip digs into the underside of the ceiling and provides a more effective anchorage. Yet, the objectionable eyesore remains in view.

The support 10 includes, as shown in FIG. 2, opposite, generally planar, major surfaces 11 and 12, a circular mounting hole 13 extending through the support between the major surfaces, a circular flange recess 14 formed between the major surfaces within the support for receiving the flange 38 of the mounted device 30, and a circular mask recess 15 formed in the support and located at the major surface 11.

A set of peripheral beveled edge regions 16 is located on the support. The support is generally square-shaped and, in the preferred embodiment, each side measures about sixteen inches in length. In some cases, the support can be circular. The height of the support measures about five-eighths of an inch. The hole 13 and the recesses 14 and 15 are concentric and have flat-bottomed boundary walls. The outer surface 11 can be provided with any pattern or shape, such as the representative checkerboard pattern 17.

To obtain smooth, continuous, flat-bottomed walls, the support is molded from a moldable material, such as plaster or plastic. FIG. 1 depicts a plaster-forming mold consisting of upper mold part 50 and lower mold part 52. Plaster is introduced between the mold parts and, after drying, the support assumes the shape depicted in FIG. 2.

Figure 3:
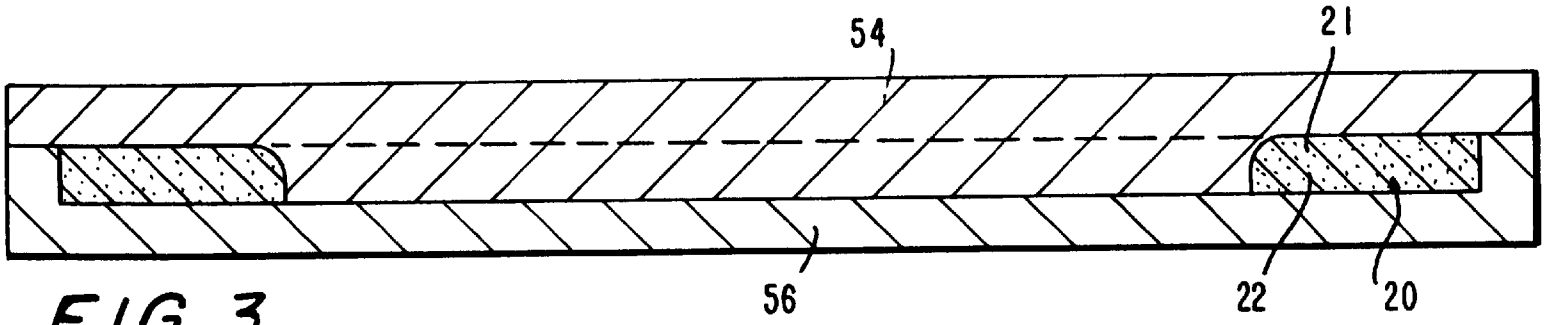
FIG. 3 is a sectional view of a mask element in accordance with the present invention during its manufacture in a different mold.
Figure 4:
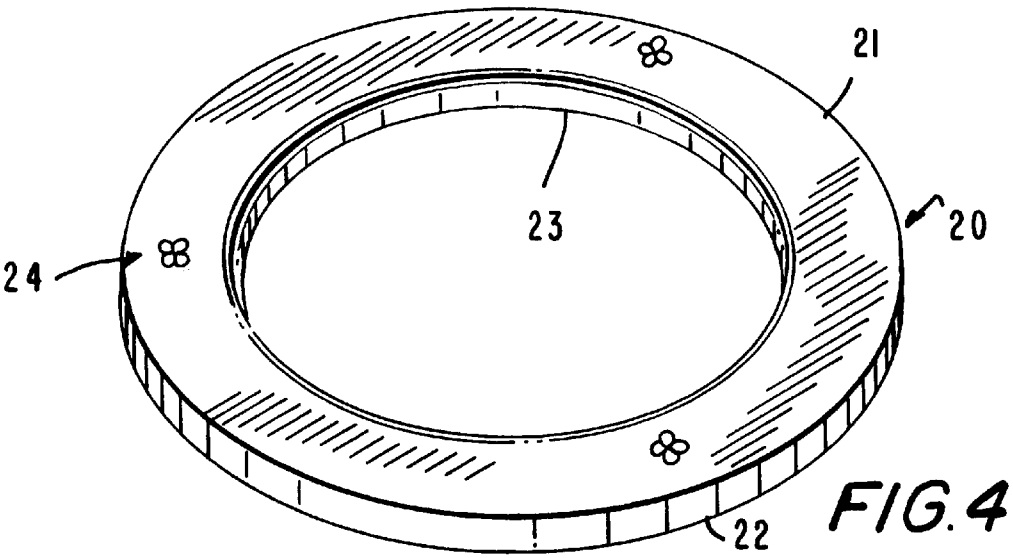
FIG. 4 is a perspective view of the finished mask element of FIG. 3 after its manufacture.

The mask element 20 has opposite, generally planar, faces 21 and 22 and a center clearance hole 23. Both faces are essentially flat. The mask element is circular and has a complementary contour to that of the mask recess 15. To obtain smooth, continuous, flat-bottomed faces, the mask element is molded from a moldable material, such as plaster. The outer face 21 can be unornamented or, as shown, can have any pattern or shape, such as the floral pattern 24. FIG. 3 depicts a plaster-forming mold consisting of upper mold part 54 and lower mold part 56. Plaster is introduced between the mold parts and, after drying, the mask element assumes the shape depicted in FIG. 4.

Turning again to FIG. 5, a ceiling 60 is depicted after a section 62 has been removed therefrom. The ceiling is made of conventional materials, e.g., plaster or gypsum. The ceiling is supported from above by joists 64 fastened to framing structure 66. The ceiling has an outer surface 68 against which the aforementioned flanges 38 and 48,49 abutted in open view in prior art installations.

In use, the support 10 is mounted in the removed ceiling section 62 and is secured therein, preferably with the aid of wall screws 70. Next, the fixture 30 is inserted through the mounting hole 13 until the flange 38 is received in and abuts the flange recess 14. The flat, smooth walls and the molding of the support assure the precise and repeated alignment of the fixture.

Thereupon, the mask element 20 is moved from its phantom line position 20A to its solid line installed position in which the mask element is received in the mask recess 15.

The outer face 21 of the mask element is flush with the outer surface 11 of the support. The circular seam 72 between the mask element and the support is spackled over with a conventional joint compound, and sanded. A reveal or beveled edge at the periphery of the outer face 21 of the mask element can be formed in order to provide more room for the joint compound to be applied. The wedge-shaped areas 74 between the beveled edge regions of the support and the outer surface 68 of the ceiling 60 are also spackled over with a conventional joint compound, and sanded. The result is a fixture that is "buried" in the ceiling. The flange 38 cannot be seen because it is covered by the mask element.

The support 10*a* and the mask element 20*a* of FIG. 6 are essentially identical to their non-lettered counterparts, except provision has been made to accommodate the lip 49. Thus, the support 10*a* also has a lip recess 80 in which the lip 49 is received. Otherwise, except for dimensional changes, the structure and operation are identical and need not be repeated.

Figure 7:
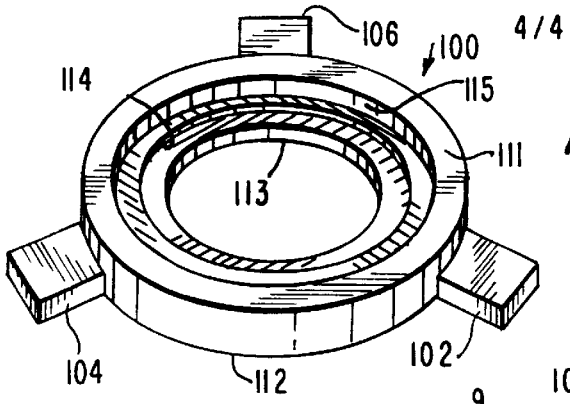
FIG. 7 is a view analogous to FIG. 2, but of another embodiment of a support.

Turning now to FIG. 7, the support 10 need not be configured as a generally planar, square tile of relatively large area, as depicted in FIG. 2, but could be configured in a more compact form, such as the generally cylindrical configuration identified by reference numeral 100 in FIG. 7. The more compact shape is better able to resist cracks or breaks during transport and handling.

As before, the support 100 has a circular mounting hole 113 extending through the support between a pair of opposite, generally planar, major surfaces 111, 112, a circular flange recess 114 formed between the major surfaces within the support for receiving the flange 38 of the mounted device 30 (see FIG. 9), and a circular mask recess 115 formed in the support and located at the major surface 111. The hole 113 and the recesses 114, 115 are concentric about a central axis and have flat-bottomed boundary walls.

The support 100 also has a peripheral flange which may extend circumferentially completely about the axis or, as shown, is embodied by a plurality of radial arms 102, 104, 106. More or less than three arms can be employed as the peripheral flange. Advantageously, the arms are equidistantly spaced around the axis, but this is not a requirement. The support 10 is molded in a one-piece unit from a moldable, non-metallic material, such as plaster or plastic.

Figure 8:
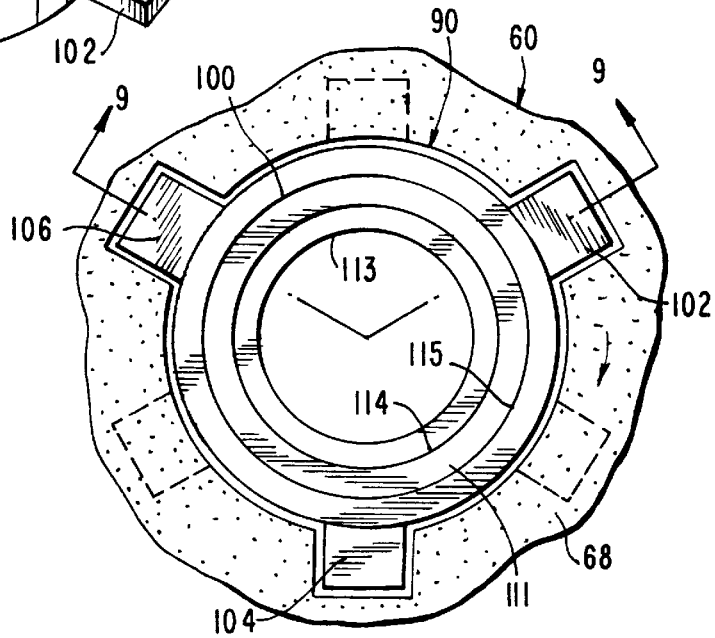
FIG. 8 is a plan view of the support of FIG. 7 during insertion into a cutout of a ceiling as viewed from below the ceiling.

FIG. 8 depicts a portion of the ceiling 60 as seen from below looking up. A cutout 90 is formed through the ceiling. The cutout has the general outline of the periphery of the support 100, which includes a circular central section and a plurality of radial sections. To assist an installer in forming the cutout, a template can be provided to mark the outline prior to removal of the marked areas. The cutout is slightly larger than the periphery of the support to allow clearance for the support to be inserted through the cutout 90.

The mounting of the support 100 on the ceiling 60 begins by aligning the arms 102, 104, 106 with the radial sections of the cutout. The support is then inserted through the cutout 90 in a direction perpendicular to the plane of the ceiling. Once the arms 102, 104, 106 clear the inner top surface of the ceiling, the support is turned, clockwise or counterclockwise, until the arms 102, 104, 106 assume their respective positions illustrated by dashed lines in FIG. 8. In the illustrated embodiment, the arms are turned through an angular distance of 60°.

Figure 9:
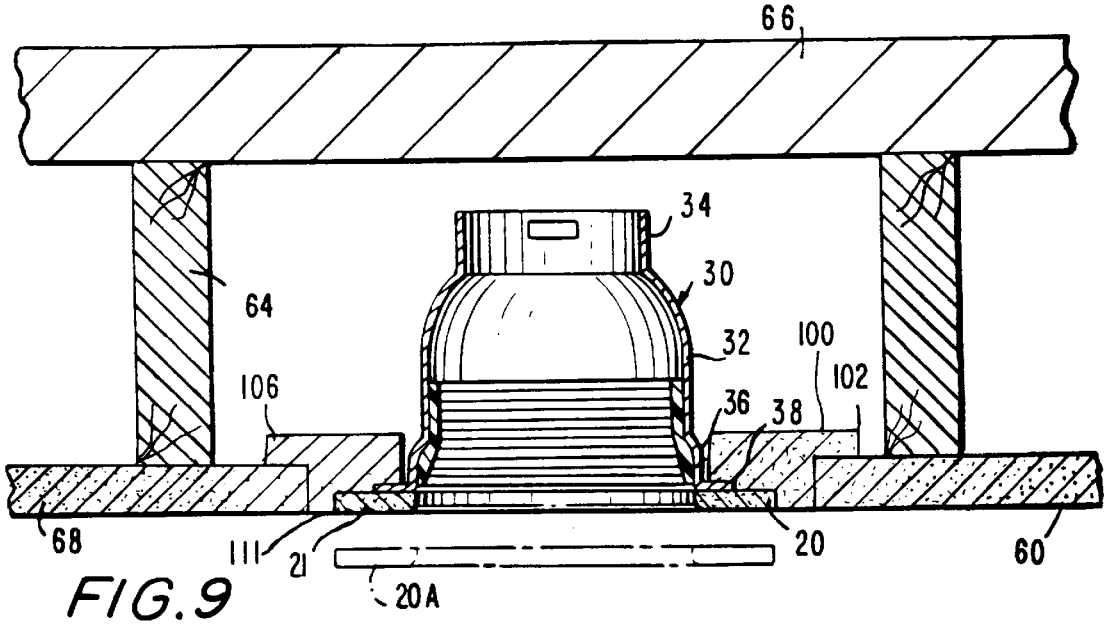
FIG. 9 is a view analogous to FIG. 5 taken on line 9—9 of FIG. 8, and showing the support of FIG. 7 in use.

As depicted in FIG. 9, the arms rest on the inner top surface of the ceiling and hold the support 100 in position. Thus, the ceiling itself, rather than the joints 64 or the framing structure 66, supports the support 100. For additional anchorage, a construction adhesive, preferably one including a plaster mixture, is placed between each arm and the inner top ceiling surface.

As before, the fixture 30 is inserted though the mounting hole 113 until the flange 38 is received in and abuts the flange recess 114. The mask element 20 is moved from its phantom line position 20A to its solid line installed position in which the mask element is received in the mask recess 115. The outer face 21 of the mask element is flush with the outer surface 111 of the support 100 and the outer surface 68 of the ceiling 60. Plaster or a joint compound is used to fill in the radial sections, as well as all exposed areas of the cutout. The filled-in areas are then sanded smooth.

In case the peripheral flange is not embodied by the plurality of arms, but instead, is constituted by a circumferentially complete, annular flange, then the ceiling cutout may be configured as a rectangular slot through which the support is inserted sideways, that is to say, the support is oriented to be perpendicular to the plane of the ceiling, and is then inserted through the slot, and is finally turned until the annular flange rests on the inner top surface of the ceiling. Since such turning requires a relatively large clearance between the ceiling and the framing structure, the ceiling cutout may also be configured as an ellipse so that the support can be inserted though a central region of the ellipse and then slid toward one of the end regions of the ellipse.

In another approach, the peripheral flange may be eliminated, and the ceiling cutout may be formed to be slightly larger than the periphery of the support so that the support can be inserted and fitted into the cutout. Construction adhesive or plaster can be used in the space between the support periphery and the ceiling cutout. Nails or analogous fasteners can be toenailed through the ceiling into the support for additional holding power. Such fasteners would be countersunk and spackled over to provide a finished appearance.

The above-described mounting arrangements and methods are well suited for retrofitting existing installations, but can equally well be used for new installations.

It will be understood that each of the elements described above, or two or more together, may also find a useful application in other types of constructions differing from the type described above.

While the present invention has been described and illustrated herein as embodied in a specific arrangement for, and a method of, mounting a light fixture in a ceiling, it is not limited to the details of this particular construction, since various modifications and structural changes may be made without departing from the spirit of the present invention.

So, for instance, the fixture need not be a lighting fixture, but could equally be any device that can be mounted on a wall of a room. Such devices may include an air vent for the passage of heating/cooling air, grilles for audio speakers, housings for detectors, etc.

In addition, the wall on which the device is to be mounted need not be the ceiling, but could equally well be any wall in the room including the upright side walls and the floor.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by letters patent is set forth in the appended claims.

I claim:

1. A mounting arrangement for concealing a flange on a device to be mounted on a wall, comprising:

a) a support comprised of a moldable, non-metallic material and having a mounting hole extending through the support for mounting the device, a flange recess formed in the support for receiving the flange of the mounted device, and a discrete mask recess formed in the support; and b) a mask element comprised of a moldable, non-metallic material and received in the mask recess and overlying the flange of the mounted device to hide the flange from view.

2. The mounting arrangement as defined in claim 1, wherein the support has opposite major surfaces, and wherein the hole extends through the major surfaces, and wherein the flange recess is located between the major surfaces within the support, and wherein the mask recess is located at one of the major surfaces.

3. The mounting arrangement as defined in claim 2, wherein the major surfaces are generally planar, wherein the hole extends along a longitudinal axis generally perpendicular to the major surfaces, and wherein the flange recess and the mask recess extend circumferentially around the axis.

4. The mounting arrangement as defined in claim 3, wherein the flange recess and the mask recess have concentric, circular configurations.

5. The mounting arrangement as defined in claim 4, wherein the flange recess and the mask recess are bounded by smooth, continuous boundary walls and have a complementary contour to the flange and the mask element, respectively.

6. The mounting arrangement as defined in claim 1, wherein the support is molded of plaster in one piece.

7. The mounting arrangement as defined in claim 1, wherein the mask element is a circular ring molded in one piece.

8. The mounting arrangement as defined in claim 3, wherein the mask element has an outer generally planar face that is flush with said one generally planar major surface of the support.

9. The mounting arrangement as defined in claim 1, wherein the support has a peripheral flange that abuts, and is supported by, the wall.

10. The mounting arrangement as defined in claim 9, wherein the flange includes a plurality of arms spaced angularly apart from one another.

11. A method of mounting a device on a wall and of concealing a flange on the mounted device, comprising the steps of:

a) forming a support comprised of a moldable, non-metallic material;

b) forming a mounting hole through the support;

c) inserting the device through the mounting hole;

d) placing the flange of the mounted device in a flange recess formed in the support;

e) forming a discrete mask recess in the support; and f) inserting a mask element comprised of a moldable, non-metallic material in the mask recess in an overlying relationship with the flange of the mounted device to hide the flange from view.

12. The method as defined in claim 11; and further comprising the steps of molding the support and the mask element of a plaster material to form smooth, continuous boundary walls for the flange recess and the mask recess.

13. The method as defined in claim 11; and further comprising the step of forming the support with an outer, generally planar surface; the step of forming the mask element with an outer, generally planar face; and the step of making the outer surface of the support flush with the outer face of the mask element.

14. The method as defined in claim 11; and further comprising the step of beveling the support with beveled edge regions at the periphery of the support; and the step of making the beveled edge regions of the support flush with the wall.

15. The method as defined in claim 11; and further comprising the step of removing a section of the wall; and the step of mounting the support in the removed section.

16. The method as defined in claim 15; and further comprising the step of forming a peripheral flange on the support; and wherein the mounting step is performed by resting the flange on an inner surface of the wall that is adjacent the removed wall section.

17. The method as defined in claim 16, wherein the flange is formed of a plurality of arms, and wherein the mounting step is performed by passing the arms through the removed wall section, and by turning the support and the arms through an angular distance until the arms overlie the inner surface of the wall.

18. A mounting arrangement for concealing a metal flange on a lighting fixture to be mounted on a ceiling, comprising:

a) a support comprised of a non-metallic material and suspended from the ceiling, the support having a mounting hole extending through the support for mounting the fixture, a flange recess formed in the support for receiving the metal flange of the mounted fixture, and a discrete mask recess formed on the support; and b) a mask element comprised of a non-metallic material and received in the mask recess and overlying the metal flange of the mounted fixture to hide the metal flange from view.

19. The mounting arrangement as defined in claim 18, wherein the ceiling has a generally planar, exterior wall surface, wherein the support has a generally planar, exterior support surface, wherein the mask element has a generally planar, exterior mask surface, and wherein all of said surfaces lie in the same plane.

20. The mounting arrangement as defined in claim 18, wherein the support has a peripheral flange that overlies, rests on, and is supported by, a generally planar, interior wall surface of the ceiling.

* * * * *